US011906206B2

(12) United States Patent
Ascani

(10) Patent No.: US 11,906,206 B2
(45) Date of Patent: Feb. 20, 2024

(54) REFRIGERATION APPARATUS AND OPERATING METHOD THEREOF

(71) Applicant: TURBOALGOR S.R.L., Massa Martana (IT)

(72) Inventor: Maurizio Ascani, Massa Martana (IT)

(73) Assignee: TURBOALGOR S.R.L., Massa Martana (IT)

( * ) Notice: Subject to any disclaimer, the term of this patent is extended or adjusted under 35 U.S.C. 154(b) by 451 days.

(21) Appl. No.: 17/287,867

(22) PCT Filed: Oct. 24, 2019

(86) PCT No.: PCT/IB2019/059100

§ 371 (c)(1),
(2) Date: Apr. 22, 2021

(87) PCT Pub. No.: WO2020/084545

PCT Pub. Date: Apr. 30, 2020

(65) Prior Publication Data

US 2021/0396431 A1 Dec. 23, 2021

(30) Foreign Application Priority Data

Oct. 26, 2018 (IT) ..... 102018000009843

(51) Int. Cl.
*F25B 1/10* (2006.01)
*F25B 1/02* (2006.01)
(Continued)

(52) U.S. Cl.
CPC ..... *F25B 1/10* (2013.01); *F25B 1/02* (2013.01); *F25B 9/008* (2013.01); *F25B 49/02* (2013.01);
(Continued)

(58) Field of Classification Search
CPC .... F25B 1/02; F25B 1/10; F25B 9/008; F25B 49/02; F25B 2400/13; F25B 2400/0401
See application file for complete search history.

(56) References Cited

U.S. PATENT DOCUMENTS

2010/0162740 A1* 7/2010 Ascani ..... F25B 1/10 62/116
2018/0258922 A1* 9/2018 Ascani ..... F25B 31/023
2019/0353414 A1* 11/2019 Karbiner ..... F25B 11/02

FOREIGN PATENT DOCUMENTS

EP 0239680 A2 10/1987
JP 2005016897 A 1/2005
(Continued)

OTHER PUBLICATIONS

International Search Report and Written Opinion for Corresponding International Application No. PCT/IB2019/059100 (10 Pages) (dated Jan. 20, 2020).

*Primary Examiner* — Marc E Norman
(74) *Attorney, Agent, or Firm* — LUCAS & MERCANTI, LLP

(57) ABSTRACT

Refrigeration apparatus (1) having a closed circuit (C) in which a flow rate (P) of coolant circulates, said closed circuit comprising at least one main branch (M) provided with at least one main compressor (2), at least one cooling device (3) to cool said coolant, expansion means (4) to expand the coolant and at least one evaporator (5), said closed circuit further comprising at least one secondary economizer branch (100) for at least one fraction of flow rate (X1) of said coolant, wherein the inlet section (100*a*) of said at least one first secondary economizer branch (100) is arranged in a length (101) of said closed circuit (C) comprised between said cooling device (3) and said expansion means (4) and the outlet section (100*b*) of said at least one secondary economizer branch (100) is arranged in proximity of the suction of
(Continued)

said main compressor (2), said main branch (M) further comprises at least one reciprocating compressor (6) arranged between said evaporator and said main compressor. Said at least one secondary economizer branch comprises at least one control device for diverting at least one portion (X2) of said fraction (X1) of coolant coming from said secondary economizer branch (100) to drive the reciprocating compressor.

21 Claims, 10 Drawing Sheets

(51) Int. Cl.
*F25B 9/00* (2006.01)
*F25B 49/02* (2006.01)

(52) U.S. Cl.
CPC ... *F25B 2400/0401* (2013.01); *F25B 2400/13* (2013.01)

(56) References Cited

FOREIGN PATENT DOCUMENTS

| | | | |
|---|---|---|---|
| WO | 2008142714 | A1 | 11/2008 |
| WO | 2018137783 | A1 | 8/2018 |

* cited by examiner

REFRIGERATION APPARATUS AND OPERATING METHOD THEREOF

CROSS-REFERENCE TO RELATED APPLICATIONS

This application is a 371 of PCT/IB2019/059100 filed Oct. 24, 2019, which claims the benefit of Italian Patent Application No. 102018000009843 filed Oct. 26, 2018.

FIELD OF THE INVENTION

The present invention refers to a refrigeration apparatus.

In particular, the refrigeration apparatus according to the invention is advantageously used in the refrigeration apparatuses that use carbon dioxide as coolant.

BACKGROUND OF THE INVENTION

As is known, a refrigeration apparatus for a coolant of the type mentioned above comprises a closed circuit in which the coolant flows and along which a compressor, a cooler to cool the coolant, an expansion valve and an evaporator are arranged.

It should be noted that reference is made to fluid cooler and not to condensers in case of carbon dioxide or other fluids having similar properties, since the coolant will always remain at the gaseous state throughout the entire thermodynamic process carried out within the refrigeration apparatus.

In order to increase the efficiency of a refrigeration apparatus that uses carbon dioxide as coolant, it is also known to use one or more secondary economizer branches for the coolant circulating within the closed circuit. It should be noted that, according to the known art, a secondary economizer branch is fluidically connected to a section of the main branch of the closed circuit comprised between the cooling device, or cooler, and the expansion valve on one side and to the main compressor on the other. Such secondary economizer branch comprises an expansion valve and a heat exchanger for exchanging heat with the main circuit, while the flow rate coming from the secondary economizer branch has a pressure intermediate between the maximum one and the minimum one, which circulates within the refrigeration device, i.e. between the pressure of the fluid at the cooling device and that at the evaporator.

In any case, also with the use of one or more secondary economizer branches, the refrigeration apparatuses that use carbon dioxide as a coolant are not convenient in terms of energy. In fact, their efficiency is still rather low.

Object of the present invention is thus to achieve a refrigeration apparatus that can use refrigeration gases, for example, of the carbon dioxide ($CO_2$) type, while increasing its efficiency with respect to those of the known art.

A further object of the invention is to achieve a refrigeration apparatus of increased efficiency that is not structurally complex.

SUMMARY OF THE INVENTION

These and other objects are achieved by a refrigeration apparatus having a closed circuit in which a flow rate of coolant circulates, said closed circuit comprising at least one main branch provided with at least one main compressor, at least one cooling device to cool said coolant, expansion means to expand the coolant and at least one evaporator, said closed circuit further comprising at least one secondary economizer branch for at least one fraction of flow rate of said coolant, wherein the inlet section of said at least one first secondary economizer branch is arranged in a section of said closed circuit comprised between said cooling device and said expansion means and the outlet section of said at least one secondary economizer branch is arranged in proximity of the suction of said main compressor, said apparatus being characterized in that said main branch further comprises at least one reciprocating compressor arranged between said evaporator and said main compressor and provided with at least one cylinder, at least one rod and at least one piston, the latter being integrally constrained to said at least one rod and translatable inside said cylinder, and in that said at least one secondary economizer branch comprises at least one control device for controlling the actuation of said at least one rod and adapted to divert at least one portion of said fraction of coolant coming from said secondary economizer branch to drive the displacement of said at least one piston and compress the coolant coming from said evaporator and contained in said cylinder, and to reintroduce said at least one portion of fraction of coolant into said secondary economizer branch during the displacement of said at least one piston in the step of suctioning the coolant coming from said evaporator, for the outflow of said at least one portion of fraction of coolant through said outlet section of said at least one secondary economizer branch, wherein said outlet section of said at least one secondary economizer branch is arranged downstream of said reciprocating compressor.

Thus, in substance, a portion of the coolant coming from the economizer branch and provided with a greater pressure than that of the coolant at the evaporator is used to provide the thrusting force of the piston of the reciprocating compressor arranged along the main branch and to thus compress the coolant coming from the evaporator. In the suctioning step of the reciprocating compressor, the same portion of coolant coming from the secondary economizer branch and used in the preceding compression step of the reciprocating compressor, is returned to the main branch in a length thereof comprised between the main compressor and the reciprocating compressor. Thus, the portion of coolant coming from the secondary economizer branch never mixes with the coolant compressed inside the reciprocating compressor and coming from the evaporator, but is readdressed in direction of the outlet section of the secondary economizer branch after having exerted a thrusting force on the piston of the reciprocating compressor, in the suctioning step of the reciprocating compressor. At the outlet section of the secondary economizer branch, the portion of coolant mixes with the coolant coming out of the reciprocating compressor.

According to a first embodiment of the invention, the cylinder of the reciprocating compressor is provided with a first chamber comprising a first port for the inflow of the coolant coming from said evaporator and a second port for the outflow of the compressed coolant contained in said first chamber in order to reach said main compressor, wherein said cylinder further comprises a second chamber fluidically separated from said first chamber by said piston and provided with at least one third port for the inflow of said portion of said at least one fraction of coolant for displacing said piston and compressing said coolant contained in said first chamber, and for the outflow of said portion of said fraction of coolant, at the end of the compression of the coolant in said first chamber, in order to reach said outlet section of said secondary economizer branch, i.e. the suction of the main compressor.

Thus, as stated above, the portion of coolant coming from the secondary economizer branch never mixes with the coolant inflowing within the first chamber, but is compressed and then comes out of the reciprocating compressor in order to reach the main compressor. The same portion of coolant that is used to push the piston during the compression step comes out of the second chamber of the cylinder of the reciprocating compressor in order to reach the outlet section of the secondary economizer branch and mix with the coolant compressed by the reciprocating compressor before entering the main compressor. Moreover, the control device for controlling the actuation of said rod comprises at least one inflow section fluidically connected with said secondary economizer branch, at least one outflow section fluidically connected with said outlet section of said secondary economizer branch, and cut-off means switching between a first configuration, wherein the fluidic connection between said inflow section and said at least one third port is allowed, for the inflow of said portion of said fraction of coolant into said second chamber, and a second configuration, wherein the fluidic connection between said outflow section and said at least one third port is allowed, for the outflow of said portion of said fraction of coolant from said second chamber and the fluidic connection between said inflow section and said at least one third port is not allowed.

In particular, the actuation control device comprises a cylinder body. Moreover, the cut-off means comprise at least one shaft translatable within said cylinder between a first position, in said first configuration, and a second position, in said second configuration. The translatable shaft is provided with a first cut-off and a second cut-off; said first cut-off and said second cut-off being arranged spaced apart from one another along said at least one translatable shaft such that, in said first position, the fluidic connection between said inflow section and said at least one third port is allowed, for the inflow of said portion of said fraction of coolant into said second chamber, and in said second position the fluidic connection between said outflow section and said at least one third port is allowed, for the outflow of said portion of said fraction of coolant from said second chamber, and the fluidic connection between said inflow section and said at least one third port is not allowed.

According to an embodiment of the invention, said at least one reciprocating compressor comprises at least one additional piston integrally constrained to said at least one rod and translatable within said cylinder, wherein said cylinder is provided with an additional first chamber comprising an additional first port for the inflow of the coolant coming from said evaporator and an additional second port for the outflow of the compressed coolant contained in said additional first chamber to reach said main compressor. Moreover, said cylinder further comprises an additional second chamber fluidically separated from said additional first chamber by said additional piston and provided with an additional third port for the inflow of an additional portion of said fraction of coolant in order to displace said additional piston and compress said coolant contained in said additional first chamber and to allow the simultaneous suction of coolant from said evaporator into said first chamber, and for the outflow of said additional portion of said fraction of coolant following the compression of the coolant contained in said additional first chamber and the simultaneous compression of the coolant contained in said first chamber by said piston.

In practice, the reciprocating compressor is of the double-acting type, thus, when the piston is in the suction step, the additional piston is in the compression step, and vice-versa. Thus, this allows to considerably increase the flow rate of coolant that can be circulated inside the closed circuit.

According to a particular aspect of the invention, said control device for controlling the actuation of said rod further comprises at least one additional outflow section fluidically connected with a length of said main branch comprised between said main compressor and said reciprocating compressor. Said cut-off means, at least when in said first position, allow the fluidic connection between said additional outflow section and said additional third port, for the outflow of said additional portion of the fraction of coolant from said additional second chamber, and at least when in said second position, allow the fluidic connection between said inflow section and said additional third port, for the inflow of said additional portion of the fraction of the coolant into said additional second chamber.

Said cut-off means comprise at least one third cut-off constrained to said translatable shaft. Such third cut-off is spaced apart from said first cut-off and said second cut-off along said translatable shaft such that, at least when said at least one translatable shaft is in said first position, the fluidic connection between said additional outflow section and said additional third port is allowed, for the outflow of said additional portion of the fraction of coolant from said additional second chamber, and at least when in said second position, the fluidic connection between said inflow section and said additional third port is allowed, for the inflow of said additional portion of the fraction of the coolant into said additional second chamber.

According to a third embodiment of the invention, said cylinder is provided with a first chamber comprising a first port for the inflow of the coolant coming from said evaporator and a second port for the outflow of the compressed coolant contained in said first chamber in order to reach said main compressor, wherein said cylinder further comprises a second chamber fluidically separated from said first chamber by said piston and provided with at least one third port for the inflow of said portion of said fraction of coolant for displacing said piston and compressing said coolant contained in said first chamber, and at least one fourth port for the outflow of said portion of said fraction of coolant, at the end of the compression of the coolant contained in said first chamber, in order to reach said outlet section of said secondary economizer branch, i.e. the suction of said compressor.

Always according to this embodiment, said control device for controlling the actuation of said rod comprises at least one inflow section fluidically connected with said secondary economizer branch, at least one outflow section fluidically connected with said outlet section of said secondary economizer branch, and cut-off means switching between a first configuration, wherein the fluidic connection between said inflow section and said at least one third port is allowed, for the inflow of said portion of said fraction of coolant into said second chamber, and a second configuration, wherein the fluidic connection between said outflow section and said at least one fourth port is allowed, for the outflow of said portion of said fraction of coolant from said second chamber and the fluidic connection between said inflow section and said at least one third port is not allowed.

According to a fourth embodiment of the invention, which includes a part of the characteristics of the third embodiment, said inflow section and said outflow section are obtained in said cylinder of said reciprocating compressor. The cut-off means comprise at least one first small piston and at least one second small piston arranged within said cylinder and translatable within a respective cylinder housing obtained in said cylinder, between a respective first position, in order to take said first configuration, and a respective second position, in order to take said second configuration. Said first small piston is provided with a first cut-off and said second small piston is provided with a second cut-off, wherein said first cut-off is adapted to uncover said at least one third port at least when said first small piston is in said first position and to cover said at least one third port at least when said first small piston is in said second position. The second cut-off is adapted to cover said at least one fourth port at least when said second small piston is in said first position and to uncover said at least one fourth port at least when said second small piston is in said second position.

In a more efficient variant of this fourth embodiment, said at least one reciprocating compressor comprises at least one additional piston integrally constrained to said at least one rod and translatable within said cylinder, wherein said cylinder is provided with an additional first chamber comprising an additional first port for the inflow of the coolant coming from said evaporator and an additional second port for the outflow of the compressed coolant contained in said additional first chamber to reach said main compressor; said cylinder further comprising an additional second chamber fluidically separated from said additional first chamber by said additional piston and being provided with an additional third port for the inflow of an additional portion of said at least one fraction of coolant in order to displace said additional piston and compress said coolant contained in said additional first chamber and allow the simultaneous suction of coolant from said evaporator into said first chamber, and with an additional fourth port for the outflow of said additional portion of said fraction of coolant at the end of the compression of the coolant contained in said additional first chamber and the simultaneous compression of coolant contained in said first chamber by said piston.

According to the fourth embodiment of the invention, in a preferred embodiment, said control device for controlling the actuation of said rod further comprises at least one additional inflow section obtained in said cylinder, fluidically connected with said secondary economizer branch. The cut-off means, at least when in said first configuration, prevent the fluidic connection between said additional inflow section and said at least one additional third port and allow the fluidic connection between said outflow section and said at least one additional fourth port, for the outflow of said additional portion of said fraction of coolant from said additional second chamber, and at least when in said second configuration, allow the fluidic connection between said additional inflow section and said at least one additional third port, for the inflow of said additional portion of said fraction of coolant into said additional second chamber and wherein the fluidic connection between said outflow section and said at least one additional fourth port is not allowed.

Moreover, said at least one first small piston is provided with an additional first cut-off and said second small piston is provided with an additional second cut-off. Said additional first cut-off is adapted to cover said at least one additional third port at least when said first small piston is in said first position and to uncover said at least one additional third port at least when said first small piston is in said second position. Moreover, said second additional cut-off is adapted to uncover said at least one additional fourth port at least when said second small piston is in said first position and to cover said at least one additional fourth port at least when said second small piston is in said second position. According to the invention, said coolant comprises carbon dioxide, or other gas or gas mixture having similar chemical and/or physical properties.

The objects are also achieved by means of a method for operating a refrigeration apparatus according at least to claim 1, said method comprising the steps of:

a) circulating said coolant along said main branch of said closed circuit;

b) circulating said at least one fraction of flow rate of said coolant along said at least one secondary economizer branch of said closed circuit;

c) driving the operations of said reciprocating compressor;

characterized in that said step c) comprises the step c1) of diverting at least one portion of said fraction of coolant coming from said secondary economizer branch in order to drive the displacement of said at least one piston of said reciprocating compressor and compress the coolant coming from said evaporator contained in said cylinder, and the step c2) of reintroducing said at least one portion of fraction of cooling liquid into said secondary economizer branch during the displacement of said at least one piston in the step of suctioning the coolant coming from said evaporator, for the outflow of said at least one portion of fraction of coolant through said outlet section of said at least one secondary economizer branch, wherein said outlet section of said at least one secondary economizer branch is arranged downstream of said reciprocating compressor.

BRIEF DESCRIPTION OF THE FIGURES

Several particular embodiments of the present invention will now be described by way of example only and without limitations with reference to the accompanying figures, in which.

5A, during the various steps of compressing and suctioning the coolant within the reciprocating compressor.

DETAILED DESCRIPTION OF A PREFERRED EMBODIMENT OF THE PRESENT INVENTION

With particular reference to such figures, 1 generally denotes the generic refrigeration apparatus according to the invention.

Figure 1:
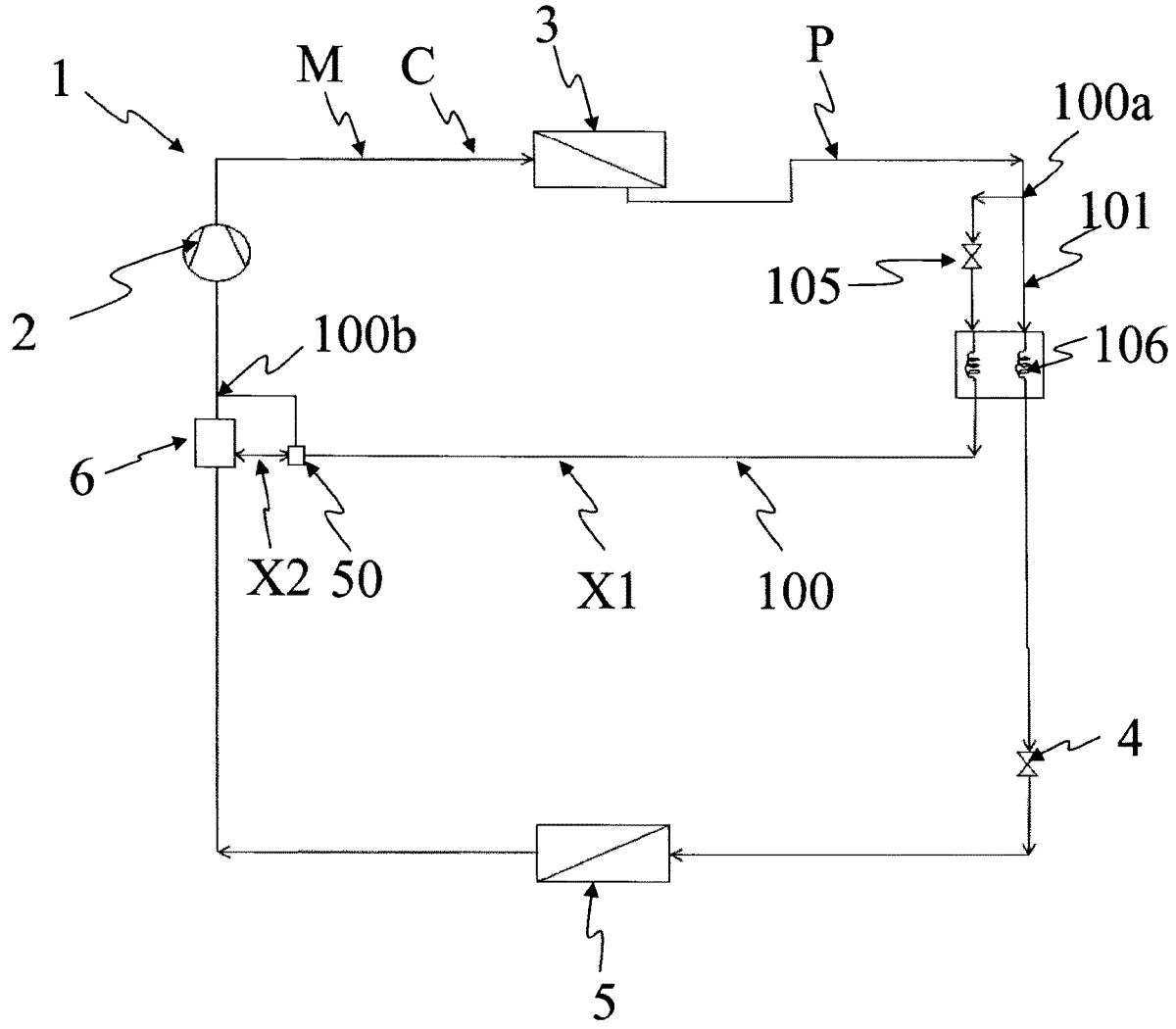
FIG. 1 is a schematic view of a refrigeration apparatus according to the invention.

As shown in an extremely simplified way in FIG. 1, the refrigeration apparatus 1 according to the invention has a closed circuit C in which a flow rate P of coolant circulates. In the case of the solution described herein, such coolant is carbon dioxide, however, the coolant can also be different in other embodiments but with similar chemical/physical properties, without departing from the protection scope of the present invention. In practice, said coolant comprises carbon dioxide, or other gas or gas mixture having similar chemical and/or physical properties. The closed circuit C comprises a main branch M provided with a main compressor 2 of the reciprocating type, at least one cooling device 3 for the coolant, expansion means 4 to expand the coolant and one evaporator 5. In this specific case, it should be noted that the cooling device 3 carries out the same functions as a condenser, i.e. cools the coolant without however changing its gaseous phase to liquid, i.e. because the coolant used is carbon dioxide. In other embodiments, in which the coolant is different from carbon dioxide, the cooling device will behave in the same way as classical condensers, i.e. transforming the aggregation state of the coolant from gaseous to liquid.

If the coolant is not carbon dioxide or has characteristics similar to this gas, the main compressor 2 could also be of the type different from the reciprocating one, for example centrifugal or other type, without however departing from the protection scope of the present invention. Moreover, in this particular case, the expansion means 4 comprise an expansion valve of the thermostatic type, in other embodiments they can comprise a capillary line or other mechanism, still however without departing from the protection scope of the present invention.

The closed circuit C further comprises a secondary economizer branch 100 for a fraction of flow rate X1 of the coolant. The inlet section 100*a* of the first secondary economizer branch 100 is arranged in a length 101 of the closed circuit C comprised between the cooling device 3 and the expansion means 4 and the outlet section 100*b* of the secondary economizer branch 100 is arranged in proximity of the suction of the main compressor 2. It should be noted that the secondary economizer branch 100 comprises, in a known way, an additional expansion valve 105 and a heat exchanger 106 to exchange heat with the main branch. A coolant, which, after the expansion step, has a pressure intermediate between that of the coolant coming out of the cooling device 3 and that of the coolant coming out of the evaporator 5, flows along the economizer branch 100.

According to the invention, the main branch M further comprises a reciprocating compressor 6 arranged between the evaporator 5 and the main compressor 2 and is equipped with a cylinder 7, a rod 8 and a piston 9, the latter being integrally constrained to the rod 8 and translatable inside the cylinder 7. Moreover, the secondary economizer branch 100, downstream of the heat exchanger 106, comprises a control device 50 for controlling the actuation of the rod 8 and adapted to divert a portion X2 of the fraction X1 of coolant coming from the secondary economizer branch 100 to drive the displacement of the piston 9 and thus compress the coolant coming from the evaporator 5 and contained in the cylinder 7 of the reciprocating compressor 6, and to reintroduce the portion X2 of fraction of coolant into the secondary economizer branch 100 during the displacement of the piston 9 in the step of suctioning the coolant coming from the evaporator 5, for the outflow of the portion X2 of fraction of coolant through the outlet section 100*b* of the secondary economizer branch 100. The outlet section 100*b* of the secondary economizer branch 100 is thus arranged downstream of the reciprocating compressor 6.

Thus, in practice, the portion X2 of the fraction X1 of the coolant passing through the secondary economizer branch is used to push the piston 9 into the cylinder 7 of the reciprocating compressor 6 thanks to the fact that its pressure is always greater than that of the coolant at the outlet of the evaporator 5. The main compressor 2 thus receives a fluid having a pressure greater than that of the coolant coming from the evaporator 4, but without using external work, such as for example an electric motor, to supply the reciprocating compressor 6. Using a numerical example, the pressure of the coolant at the outlet of the evaporator 5 is of about 20 bars, that of the coolant at the suction of the main compressor 2 is of about 24 bars, while the pressure of the portion X2 of the fraction X1 of coolant flowing along the economizer branch 100 and which is exploited to displace the piston 9 is of about 45 bars.

Figure 1A:
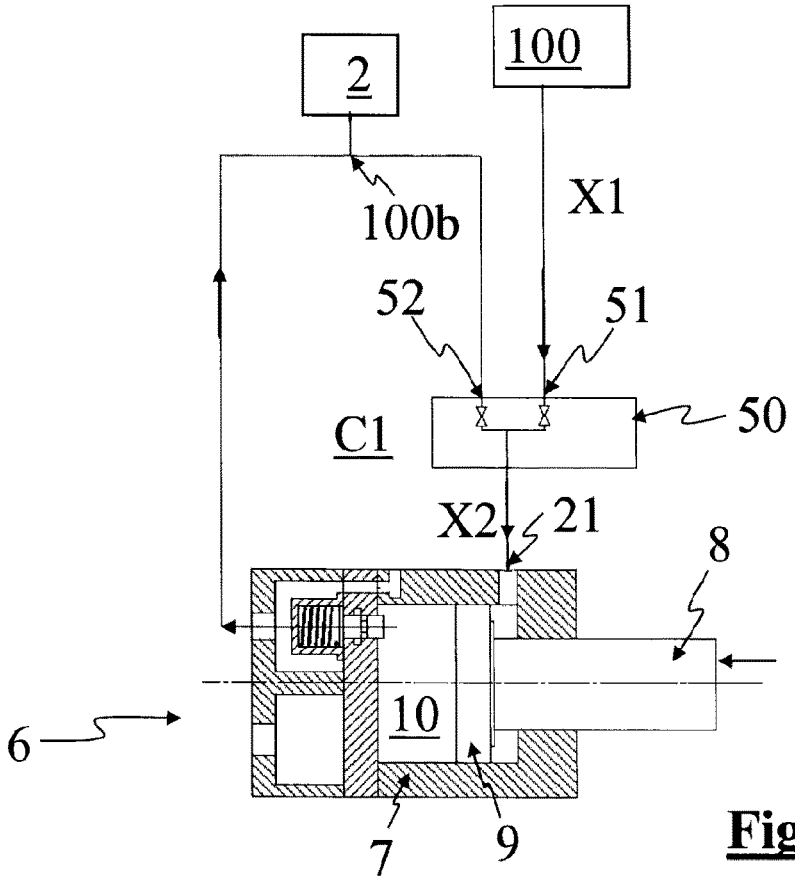
FIGS. 1A-1B are schematic sectional longitudinal views of the reciprocating compressor in a first embodiment of the refrigeration apparatus according to the invention, during the steps of, respectively, compressing and suctioning the coolant.
Figure 1B:
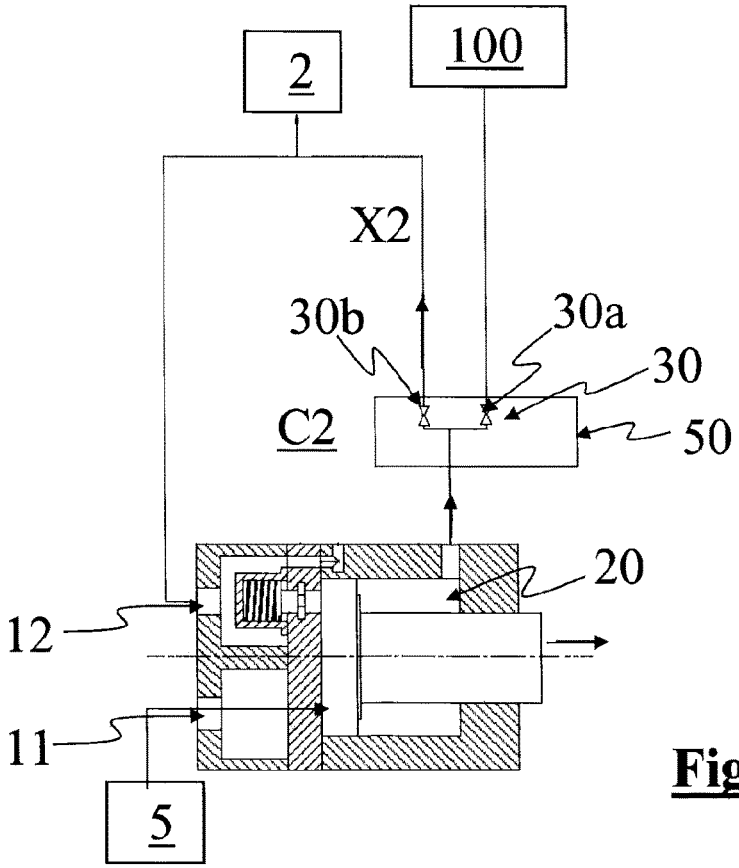

According to a first embodiment of the apparatus 1 shown in FIGS. 1A and 1B, the cylinder 7 of the reciprocating compressor 6 is provided with a first chamber 10 comprising a first port 11 for the inflow of the coolant coming from the evaporator 5, during the suctioning of the reciprocating compressor 6, and a second port 12 for the outflow of the compressed coolant contained in the first chamber 10, at the end of the compression step, in order to then reach the main compressor 2. The cylinder 7 further comprises a second chamber 20 fluidically separated from the first chamber 10 by the piston 9 and provided with a third port 21 for the inflow of the portion X2 of the fraction X1 of coolant to displace the piston 9, thus also the rod 8, and to thus compress the coolant contained in the first chamber 10, and for the outflow of the portion X2 of the fraction of coolant X1, at the end of the compression of the coolant contained in the first chamber 10, in order to then reach the inlet of the main compressor 2 through the outlet section 100*b* of the economizer branch 100.

The initial step of compressing the coolant coming from the evaporator 5, at a pressure of about 20 bars, and contained in the first chamber 10 is shown in FIG. 1A. The portion X2 of the fraction X1 of the coolant at a pressure of about 45 bars enters the second chamber 20 through the port 21 and thus pushes the piston 9 in a direction such that to compress the coolant contained in the first chamber 10. Following the compression step, i.e. when the first chamber 10 is completely emptied and the compressed coolant was expelled by the cylinder 7 through the second port 12, the piston 9 is subjected to the pressure of the fluid that starts to enter the first chamber 10 through the first port 11, while the portion of coolant X2 comes out of the second chamber 20 through the third port 21. The outflow of the portion X2 of the fraction of coolant is ensured by the fact that, as will later be clearer in the description reported below, during the suctioning of the reciprocating compressor 6, the only pressure acting on the piston 9, on the side of the second chamber 20, is the atmospheric one.

In particular, the control device 50 for controlling the rod 8 comprises an inflow section 51 fluidically connected with the secondary economizer branch 100, on the side of the inlet section 100*a*, an outflow section 52 fluidically connected with the outlet section 100*b* of the secondary economizer branch 100, and cut-off means 30 switching from a first configuration C1, wherein the fluidic connection between the inflow section 51 and the third port 21 is allowed, for the inflow of the portion X2 of the fraction X1 of coolant into the second chamber 20 (see FIG. 1A), and a second configuration C2, wherein the fluidic connection between the outflow section 52 and the aforesaid third port 21 is allowed, for the outflow of the portion X2 of the fraction X1 of coolant from the second chamber 20 and the fluidic connection between the inflow section 51 and the third port 21 is simultaneously not allowed (see FIG. 1B). The fluidic connection between the outflow section 52 and the third port 21 is also simultaneously not allowed in the first configuration C1.

It should be specified that the thermodynamic conditions of the coolant at the inflow section 51 are those obtained downstream of the additional expansion valve 105 and of the heat exchanger 106 which are present along the secondary economizer branch 100. Thus, when writing, as done above and as will also be done below, that the inflow section 51 is fluidically connected with the secondary economizer branch 100, on the side of the inlet section 100*a*, we just refer to the fact that the coolant entering through the inflow section 51 is in the thermodynamic conditions of the fluid that crossed the additional expansion valve 105 and the heat exchanger 106 which are present along the secondary branch.

In the embodiment described in FIGS. 1A and 1B, the drive device 50 comprises cut-off means 30 comprising two valves 30*a*, 30*b* fluidically connected, respectively, to the economizer branch 100 on the side of the inlet section 100*a* and to the outlet section of the economizer branch 100*b* on one side, and to the third port 21 on the other. Such valves 30*a*, 30*b* open and close in an appropriately synchronized way to alternately switch the configuration of the drive device 50 between the first configuration C1 and the second configuration C2, and vice-versa.

According to a variant of the embodiment described above and shown in FIGS. 2A and 2B, the control device 50 for controlling the actuation comprises a cylinder body 55 and the cut-off means 30 comprise a translatable shaft 31 translating inside the cylinder 55 between a first position P1, when the cut-off means 30 take the first configuration C1, and a second position P2, when the cut-off means 30 take the second configuration C2. The translatable shaft 31 is provided with a first cut-off 32 and a second cut-off 33. The first cut-off 32 and the second cut-off 32 are arranged spaced apart from one another along the translatable shaft 31 such that, in the first position P1 of the shaft 31, the fluidic connection between the inflow section 51 and the third port 21 is allowed, for the inflow of the portion X2 of the fraction X1 of coolant into the second chamber 20, to compress the coolant contained in the first chamber 10. During this step, the fluidic connection between the third port 21 and the outflow section 52 is simultaneously not allowed. The fluidic connection between the outflow section 52 and the third port 21 is allowed in the second position P2 of the translatable shaft 31, for the outflow of the portion X2 of the fraction X1 of coolant from the second chamber 20, and the fluidic connection between the inflow section 51 and the third port 21 is simultaneously not allowed. The suction of the coolant coming from the evaporator 5 into the first chamber 10 occurs in this step. In practice, in the first position P1 of the shaft 31, the first cut-off 32 covers the outflow section 52, while the second cut-off 33 uncovers the inflow section 51; in the second position of the shaft 31, the first cut-off 32 uncovers the outflow section 52, while the second cut-off 33 covers the inflow section 51.

Figure 3:
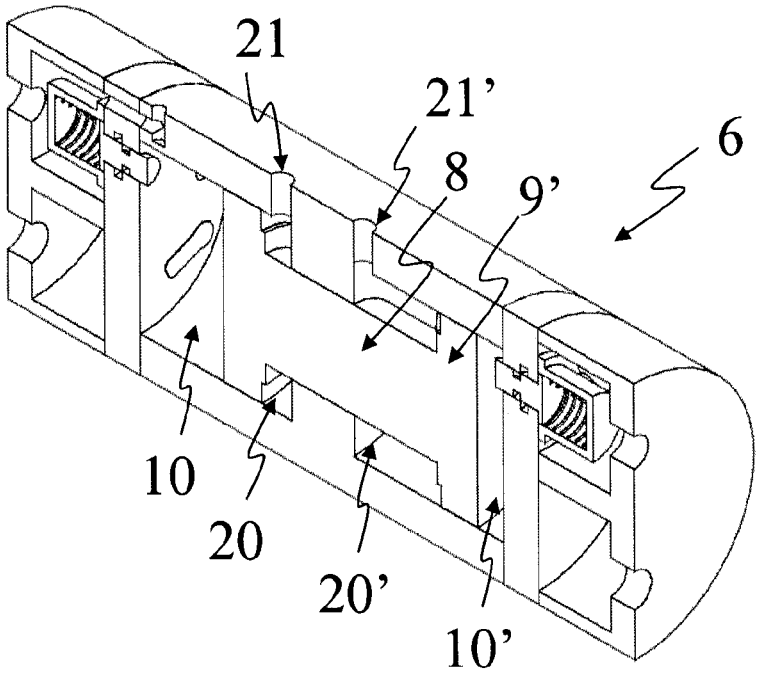
FIG. 3 is an axonometric sectional longitudinal view of the reciprocating compressor according to a second embodiment of the invention.

An axonometric sectional longitudinal view of the reciprocating compressor 6 according to a second embodiment of the invention is shown in FIG. 3. Different operating steps of the reciprocating compressor 6 always according to the second embodiment of the invention are shown in FIGS. 3A to 3D.

In particular, as shown in the aforesaid figures, the reciprocating compressor 6 comprises, in addition to the elements present in the first embodiment described above, an additional piston 9' integrally constrained to the rod 8 and translatable within the cylinder 7. Such additional piston 9' is in a position opposite that of the piston 9 along the rod 8. In such embodiment, the cylinder 7 of the reciprocating compressor 6 is provided with an additional first chamber 10' comprising an additional first port 11' for the inflow of the coolant coming from the evaporator 5 and with an additional second port 12' for the outflow of the compressed coolant contained in the additional first chamber 10', to reach the main compressor 1. In practice, such reciprocating compressor 6 is of the double-acting type. The cylinder 7 of the reciprocating compressor 6 further comprises an additional second chamber 20' fluidically separated from the additional first chamber 10' by the additional piston 9' and provided with an additional third port 21', for the inflow of an additional portion X2' of the fraction X1 of coolant coming from the economizer branch 100, to displace the additional piston 9' and to thus compress the coolant contained in the additional first chamber 10' and further allow the simultaneous suction of the portion X2 of coolant from the evaporator 5 inside, this time, the first chamber 10. Such additional third port 21' is also adapted to allow the outflow of the additional portion X2' of the fraction X1 of coolant following the compression of the coolant contained in the additional first chamber 10' and the simultaneous compression of the coolant contained in the first chamber 10 by means of the piston 9. It should be noted that the second chamber 20 and the additional second chamber 20' are not fluidically connected to each other.

In such embodiment, the control device 50 for controlling the actuation of the rod 8 further comprises at least one further outflow section 52' fluidically connected with the outlet section 100*b* of the secondary branch 100, thus with a length of the main branch M comprised between the main compressor 2 and the reciprocating compressor 6. Moreover, the cut-off means 30, at least when in the first position P1 (see FIGS. 3A and 3B), allow the fluidic connection between the additional outflow section 52' and the additional third port 21', for the outflow of the additional portion X2' of the fraction of coolant X1 from the additional second chamber 20', and at least when in the second position P2, allow the fluidic connection between the inflow section 51 and the additional third port 21', for the inflow of the additional portion X2' of the fraction X1 of the coolant into the additional second chamber 20'.

Figure 3A:
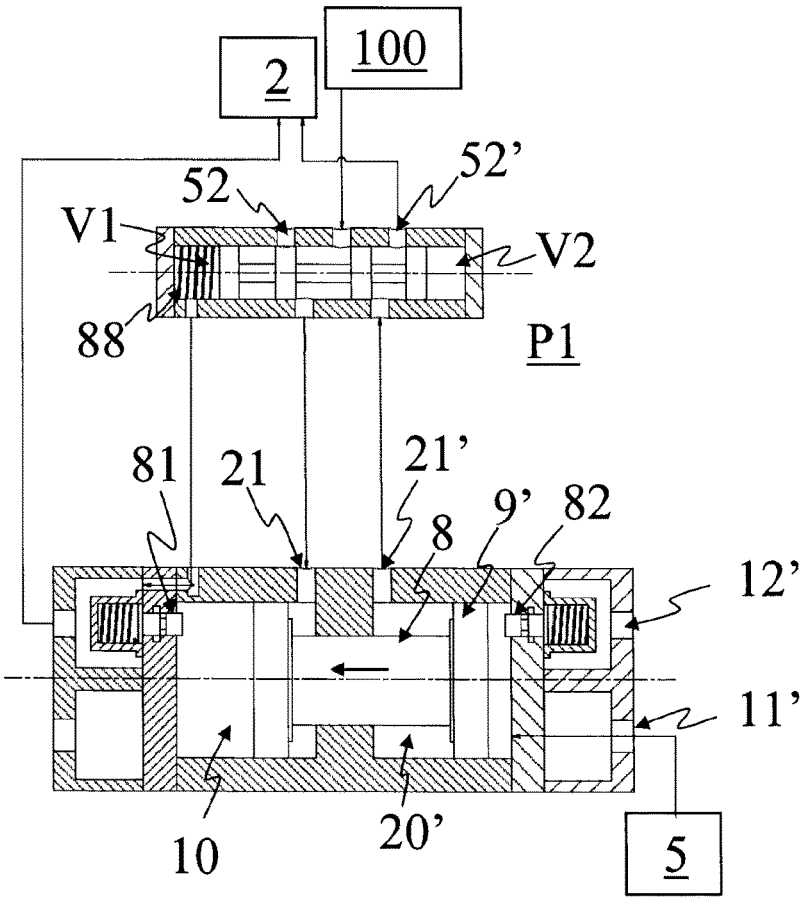
FIGS. 3A to 3D are schematic sectional longitudinal views of the reciprocating compressor in the embodiment of FIG. 3, during the various steps of compressing and suctioning the coolant within the compressor.
Figure 3B:
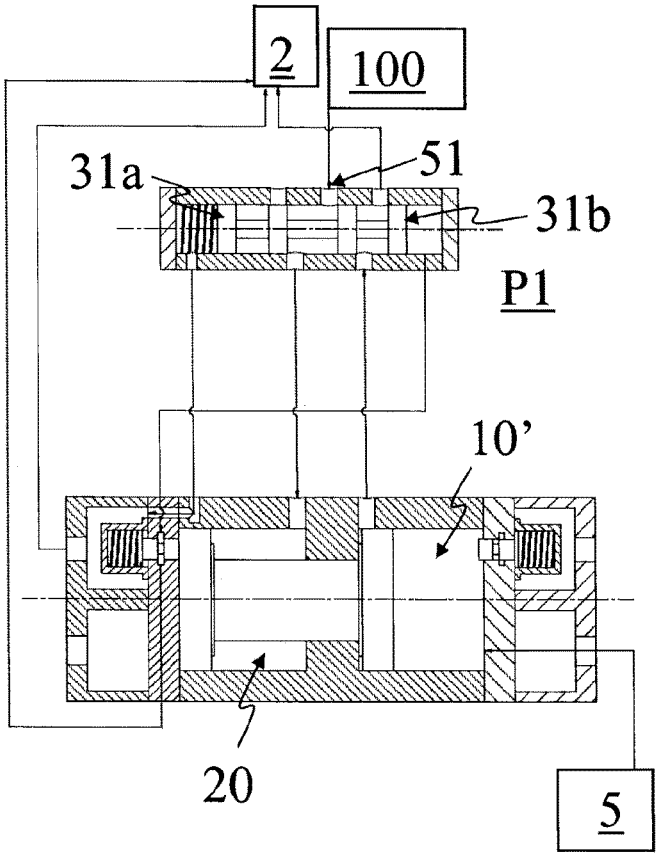
Figure 3C:
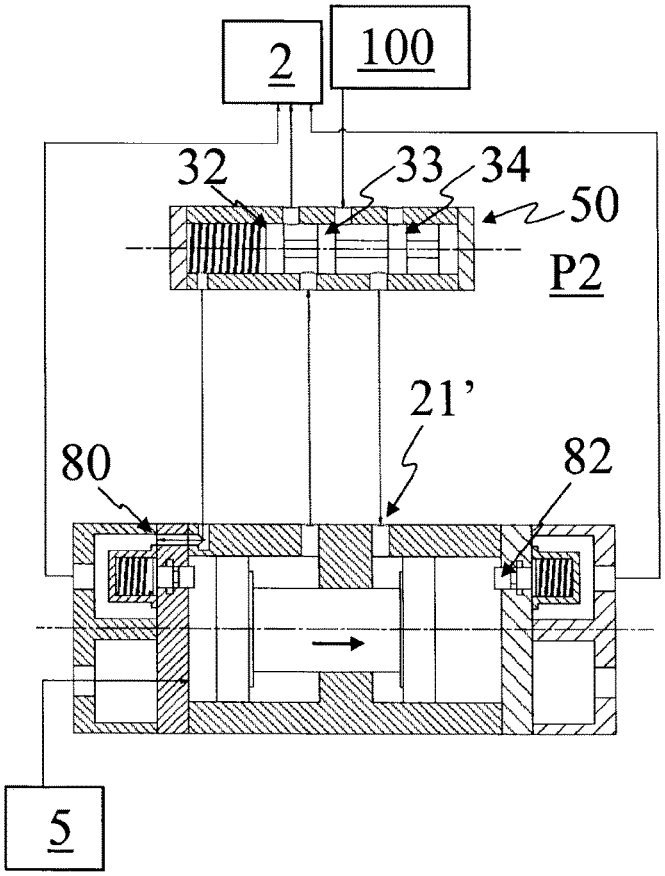
Figure 3D:
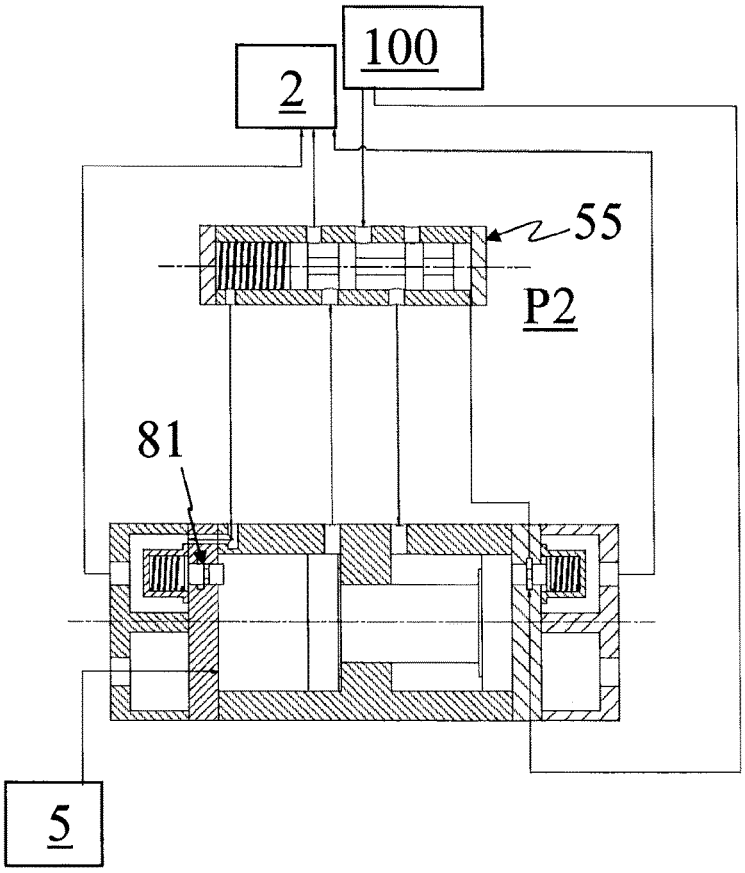

Thus, consequently to that which was said above, when the cut-off means 30 are in the first position P1, the fluidic connection between the inflow section 51 and the third port 21 is allowed, for the inflow of the portion X2 of the fraction X1 of coolant into the second chamber 20, to compress the coolant contained in the first chamber 10 and, simultaneously, the fluidic connection between the additional outflow section 52' and the additional third port 21' is allowed, for the outflow of the additional portion X2' of the fraction of coolant X1 from the additional second chamber 20' (see FIGS. 3A and 3B). Thus, the cut-off means 30, when in the first position P1, neither allow the fluidic connection between the outflow section 52 and the third port 21 nor the fluidic connection between the inflow section 51 and the additional third port 21'. When the cut-off means 30 are instead in the second position P2, the fluidic connection between the outflow section 52 and the third port 21 is allowed, for the outflow of the portion X2 of the fraction X1 of coolant from the second chamber 20 and, simultaneously, the fluidic connection between the inflow section 51 and the additional third port 21' is allowed, for the inflow of the additional portion X2' of the fraction X1 of the coolant into the additional second chamber 20'. Thus, the cut-off means 30, when in the second position P2, neither allow the fluidic connection between the inflow section 51 and the third port 21 nor the fluidic connection between the additional outflow section 52' and the additional third port 21'.

In particular, in the embodiment described herein, the cut-off means 30 comprise a third cut-off 34 constrained to the translatable shaft 31. Such third cut-off 34 is spaced apart from the first cut-off 32 and from the second cut-off 33, along the shaft 31, so that, at least when the translatable shaft 31 is in its first position P1, the fluidic connection between the additional outflow section 52' and the additional third port 21' is allowed, for the outflow of the additional portion X2' of the fraction of coolant X1 from the additional second chamber 20', and when in its second position P2, the fluidic connection between the inflow section 51 and the additional third port 21' is allowed, for the inflow of the additional portion X2' of the fraction X1 of the coolant into the additional second chamber 20'.

In practice, in the first position P1 of the shaft 31, the first cut-off 32 covers the outflow section 52, while the third cut-off 34 uncovers the additional outflow section 52'. In the second position P2 of the shaft 31, the first cut-off 32 uncovers the outflow section 52, while the third cut-off 34 covers the additional outflow section 52'. Both in the first position P1 and in the second position P2, the second cut-off 33 always keeps the inflow section 51 uncovered, but takes a position such that to divert the portion X2 of the fraction X1 of coolant, or the additional portion X2' of the fraction X1 of coolant, in direction of the third port 21 or of the additional third port 21'.

According to the particular embodiment described herein, the control device 50 for controlling the actuation of the rod 8 comprises drive means 80 to drive the switching of the cut-off means 30 between the first configuration C1 and the second configuration C2, and vice versa, depending on the position of the rod 8 within the cylinder 7.

In the embodiment described herein, such drive means 80 to drive the switching of the configuration of the cut-off means 30 act on the translatable shaft 31 by displacing it from the first position P1 to the second position P2. Such drive means 80 can also be used likewise in the embodiment described in FIGS. 2A and 2B.

In particular, in the embodiment described in FIGS. 3A to 3D, the drive means 80 comprise a switching button 81 arranged within the first chamber 10 and a second switching button 82 arranged within the additional first chamber 20'. The first switching button 81 is activated by the piston 9, at the end of the step of compressing the coolant contained in the first chamber 20, in order to drive the switching of the cut-off means 30 from the first configuration C1 to the second configuration C2 (see FIGS. 3B and 3C), i.e. to displace the translatable shaft 31 from its first position P1 to its second position P2. The second switching button 82 is activated by the additional piston 9', at the end of the step of compressing the coolant contained in the additional first chamber 20', in order to drive the switching of the cut-off means 30 from the second configuration C2 to the first configuration C1, i.e. to drive the displacement of the translatable shaft 31 from the second configuration C2 to the first configuration C1 (see FIGS. 3D and 3A).

The displacement of the translatable shaft 31 is then obtained thanks to the pressure exerted by the coolant onto the ends 31*a* and 31*b* of the translatable shaft 31. In this case, the coolant is in fact withdrawn from two distinct points of the closed circuit C in which there are distinct pressures such that, on command of the first switching button 81 and of the second switching button 82, the ends 31*a*, 31*b* of the translatable shaft 31 are thus subjected to different pressures specifically adapted to modify just the position of the translatable shaft 31 itself from its first position P1 to its second position P2, and vice-versa.

In specific, the cylinder body 55 of the control device for controlling the actuation 50 comprises a first terminal volume V1 fluidically connected with the length of the main branch M comprised between the main compressor 2 and the reciprocating compressor 6, and a second terminal volume V2 fluidically connected in a controlled and reciprocating way with the length of the main branch M comprised between the main compressor 2 and the reciprocating compressor 6, when the first switching button 81 is activated by the piston 9, in order to displace the translatable shaft 31 from its first position P1 to its second position P2, and with the secondary economizer branch 100, at least when the second switching button 82 is activated by the additional piston 9', in order to displace the translatable shaft 31 from its second position P2 to its first position P1. It should be noted that in the length of the main branch M comprised between the main compressor 2 and the reciprocating compressor 6, the pressure of the coolant will always be lower than that of the coolant in the secondary economizer branch 100. Such fluidic connections thus allow to directly urge the translatable shaft 31 to displace itself from a first position P1 and a second position P2, and vice-versa, without using external mechanisms, but by only using simple fluidic connections of the drive device 50 at points of the closed circuit C in which the coolant is at different pressures. Moreover, the first volume V1 comprises an elastic element 88 to force the cut-off means 30, but in particular the translatable shaft 31 at its first end 31*a*, to remain in its second configuration C2. Such elastic element 88 is essential when the pressure in the first volume V1 and in the second volume V2 is identical since in this case, thanks to the elastic force exerted by the elastic element 88 on the first end 31*a* of the translatable shaft 31, the latter will be displaced from its first position P1 to its second position P2, while when the second volume V2 will be in fluidic connection with the economizer branch 100, then the force exerted by the coolant on the second end 31*b* of the translatable shaft 31 will involve the displacement of the translatable shaft itself 31 from its second position P2 to its first position P1, thus overcoming both the pressure acting in the first volume V1 and the force produced at the elastic element 88 on the first end 31*a*.

Figure 2A:
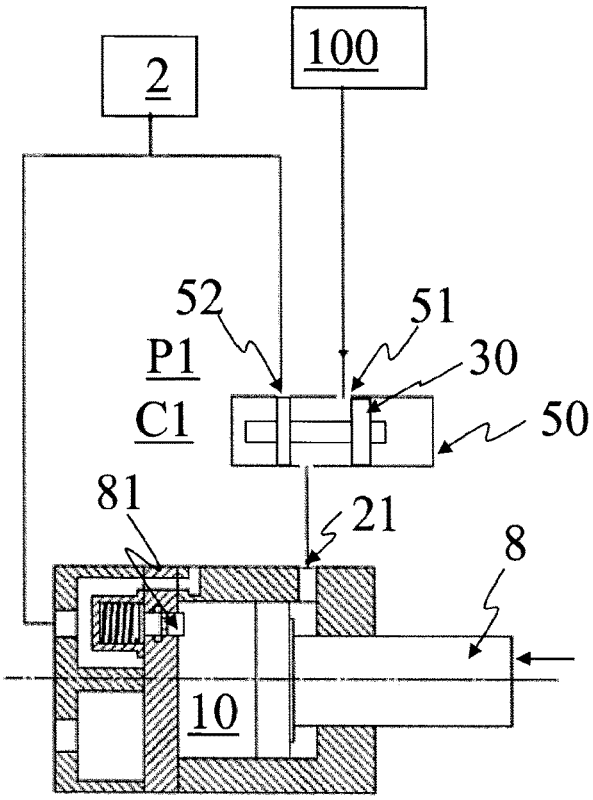
FIGS. 2A-2B are schematic sectional longitudinal views of the reciprocating compressor in a variant of the first embodiment of the refrigeration apparatus according to the invention, during the steps of, respectively, compressing and suctioning the coolant.
Figure 2B:
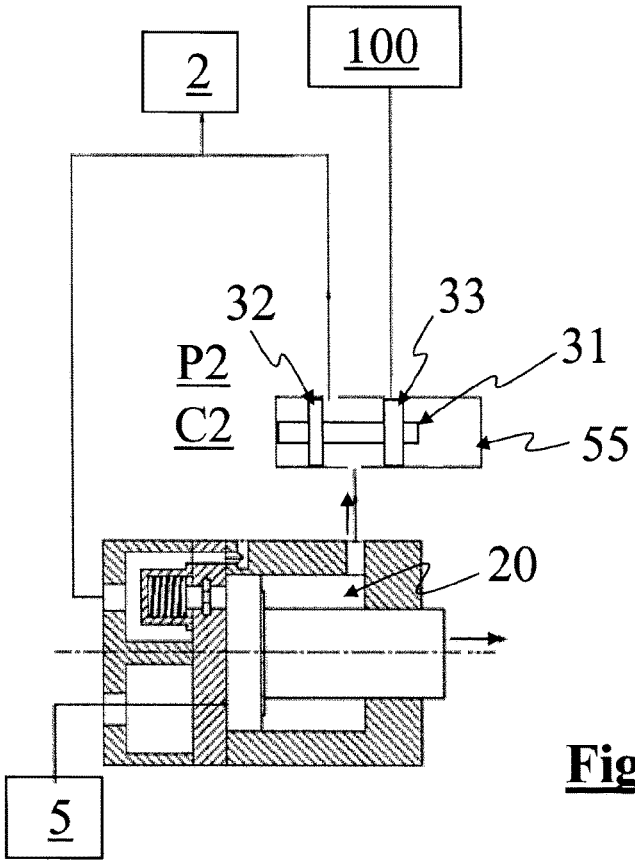

In the embodiment shown in FIGS. 2A and 2B, the drive means 80 to drive the activation of the cut-off means 30 are similar to those described above, however, in that case, the second switching button 82 (not shown in FIGS. 2A and 2B) is arranged within the second chamber 20 and is pressed, not by the additional piston 9' but by the piston 9 in its return stroke during the suction of the reciprocating compressor 6, on the side in contact with the second chamber 20 of the cylinder 8. The fluidic connections between the end volumes V1 and V2 of the drive device 50 are the same as those of the embodiment described in FIGS. 3A and 3D.

Figure 4A:
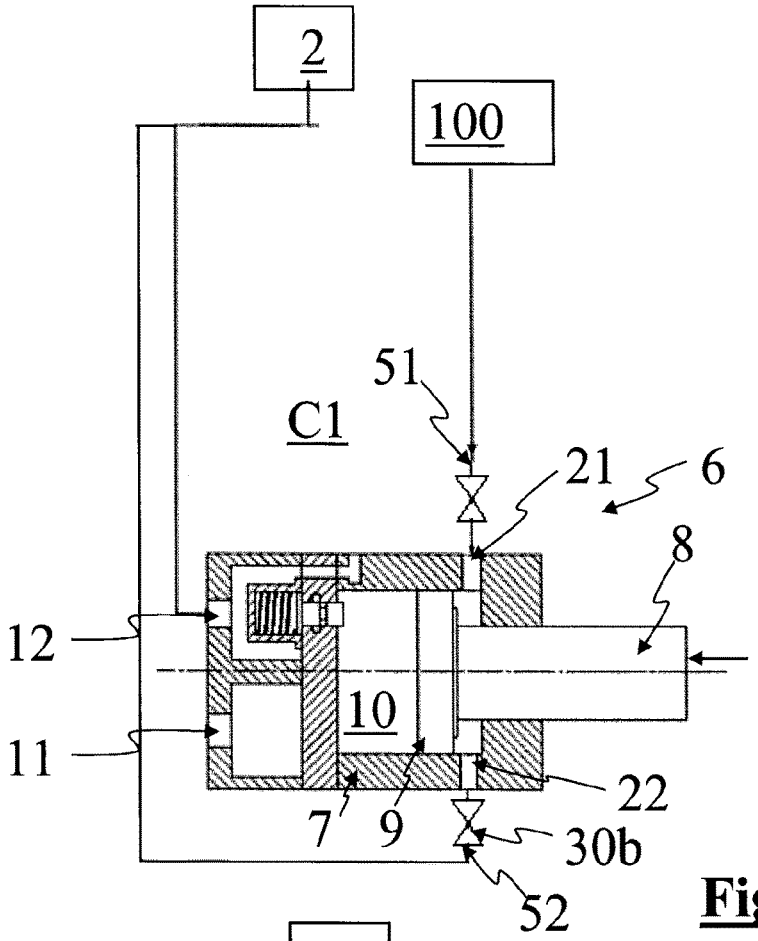
FIG. 4A is a sectional longitudinal view of the compressor according to a third embodiment of the invention, during the compression step.
Figure 4B:
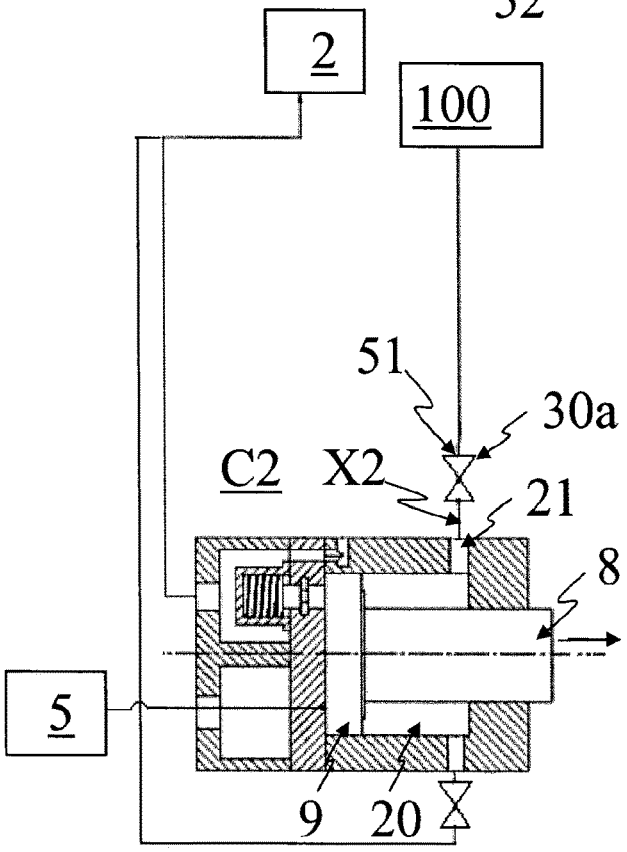
FIG. 4B is a sectional longitudinal view of the compressor of FIG. 4A in the step of suctioning.
Figure 5A:
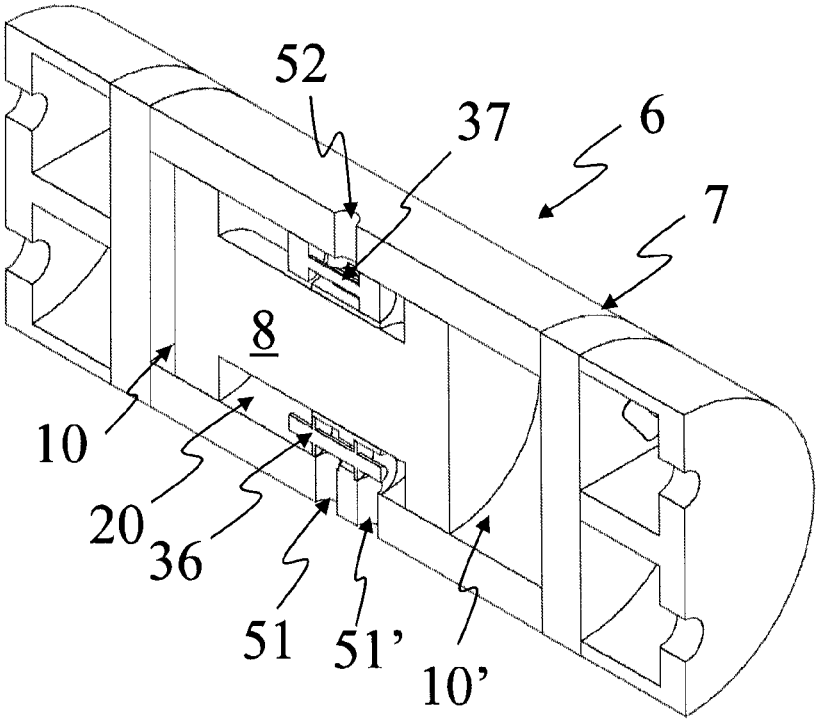
FIG. 5A is an axonometric sectional longitudinal view of the compressor according to a fourth embodiment of the invention.
Figure 5B:
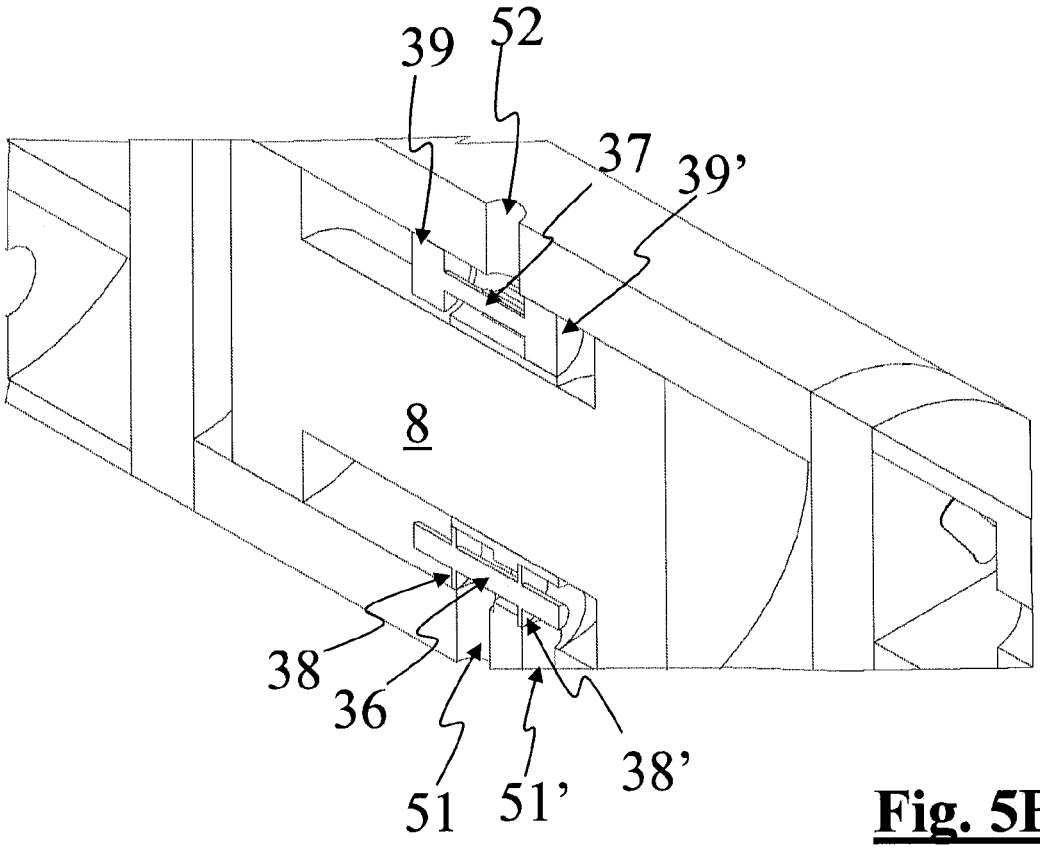
FIG. 5B is a particular view of the longitudinal section of the compressor of FIG. 5A.

A third embodiment of the invention is depicted in FIGS. 4A and 4B. Equally to the first embodiment described above, also in this solution, the cylinder 7 of the reciprocating compressor 6 is provided with a first chamber 10 comprising a first port 11 for the inflow of the coolant coming from the evaporator 5 and a second port 12 for the outflow of the compressed coolant contained in the first chamber 10, to reach the main compressor 2. The cylinder 7 further comprises a second chamber 20 fluidically separated from the first chamber 10 by the piston 9 and provided with a third port 21 for the inflow of the portion X2 of the fraction X1 of coolant to displace the piston 9 and compress the coolant contained in the first chamber 10. Unlike the first embodiment, the second chamber 20 is further provided with a fourth port 22 for the outflow of the portion X2 of the fraction X1 of coolant, at the end of the compression of the coolant contained in the first chamber 10, in order to reach the outlet section 100*b* of the secondary economizer branch 100. The control device 50 for controlling the actuation of the rod 8 comprises an inflow section 51 fluidically connected with the secondary economizer branch 100 on the side of the inlet section 100*a* thereof, and an outflow section 52 fluidically connected with the outlet section 100*b* of the secondary economizer branch 100, and cut-off means 30 switching from a first configuration C1, wherein the fluidic connection between the inflow section 51 and the third port 21 is allowed, for the inflow of the portion X2 of the fraction X1 of the coolant into the second chamber 20, and a second configuration C2, wherein the fluidic connection between the outflow section 52 and the fourth port 22 is allowed, for the outflow of the portion X2 of the fraction X1 of the coolant from the second chamber 20 and the fluidic connection between the inflow section 51 and the third port 21 is not allowed. The fluidic connection between the outflow section 52 and the fourth port 22 is also not allowed in the first configuration C1.

Thus, ultimately, unlike the embodiment shown in FIGS. 1A and 1B, the cylinder 7 of the reciprocating compressor 6 has a fourth port 22 able to allow the outflow of the portion X2 of fraction X1 of the coolant coming from the secondary economizer branch 100.

Like in the first embodiment, the drive device 50 comprises cut-off means 30 comprising two valves 30*a*, 30*b* fluidically connected, respectively, to the economizer branch 100 on the side of the inlet section 100*a*, and to the outlet section 100*b* of the economizer branch 100 on one side, and to the third port 21 and the fourth port 22 on the other. Such valves 30*a*, 30*b* open and close in an appropriately synchronized way to alternately switch the configuration of the drive device 50 between the first configuration C1 and the second configuration C2, and vice-versa.

A refrigeration apparatus 1 in a fourth embodiment is shown in FIGS. 5A, 5B and 6A to 6D. In this embodiment, the cylinder 7 comprises a second chamber 20 fluidically separated from the first chamber 10 by the piston 9 and provided with a third port 21 for the inflow of the portion X2 of the fraction X1 of coolant, to displace the piston 9 and compress the coolant contained in the first chamber 10, and with a fourth port 22 for the outflow of said portion X2 of the fraction X1 of coolant, at the end of the compression of the coolant contained in the first chamber 10, in order to reach the outlet section 100*b* of the secondary economizer branch 100.

Figure 6A:
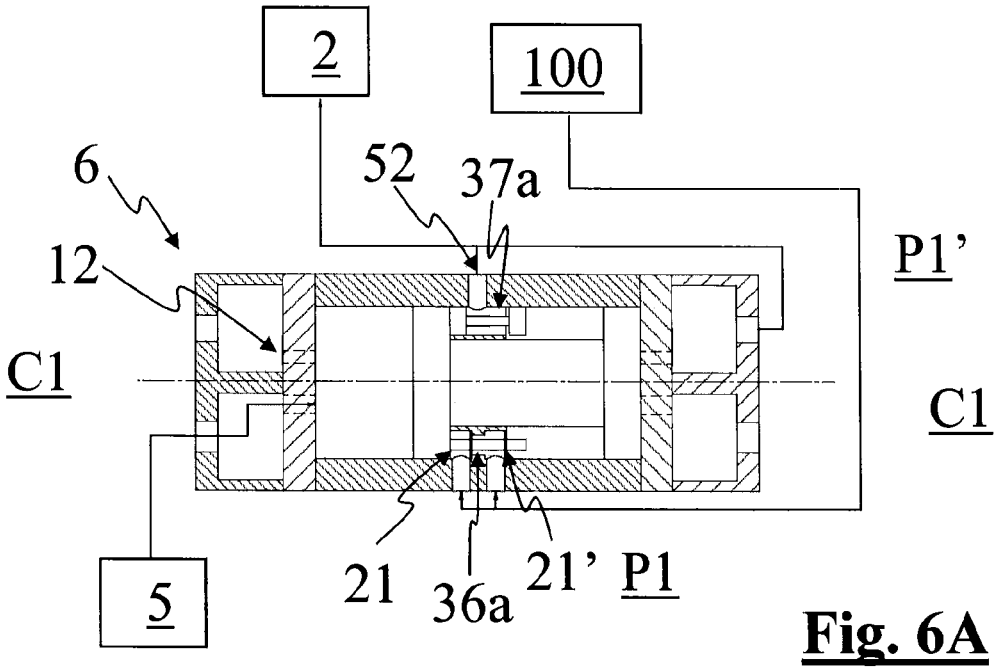
FIGS. 6A-6D are schematic sectional longitudinal views of the reciprocating compressor in the embodiment of FIG.
Figure 6B:
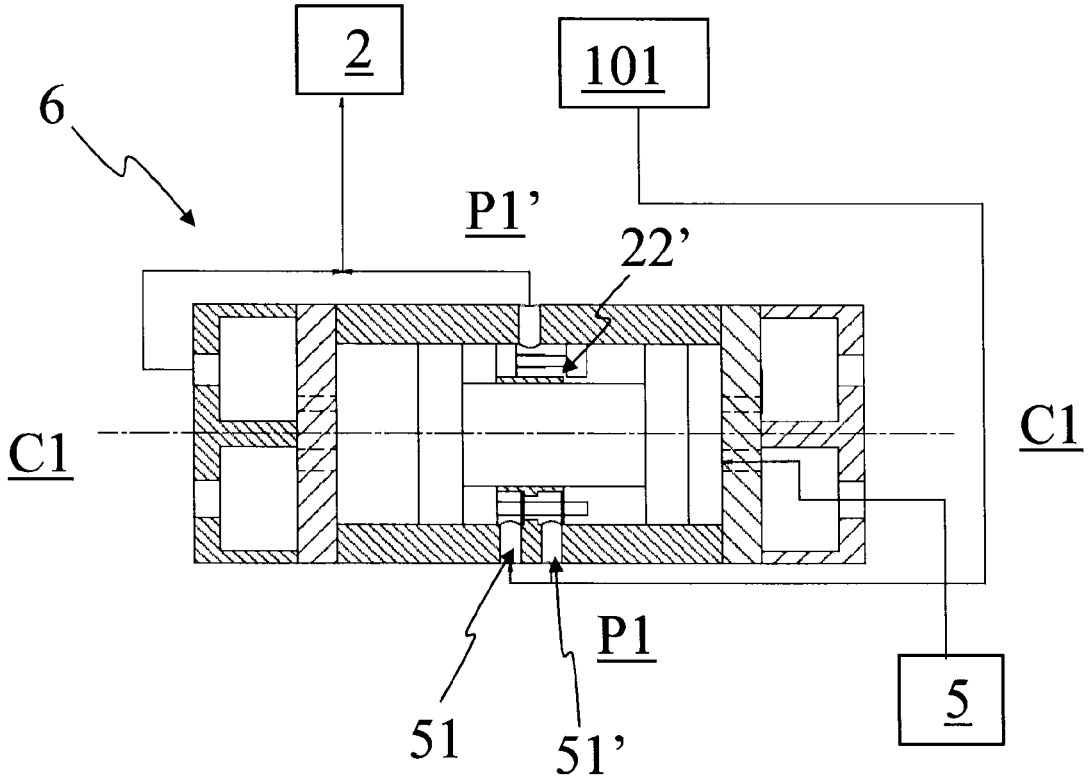
Figure 6C:
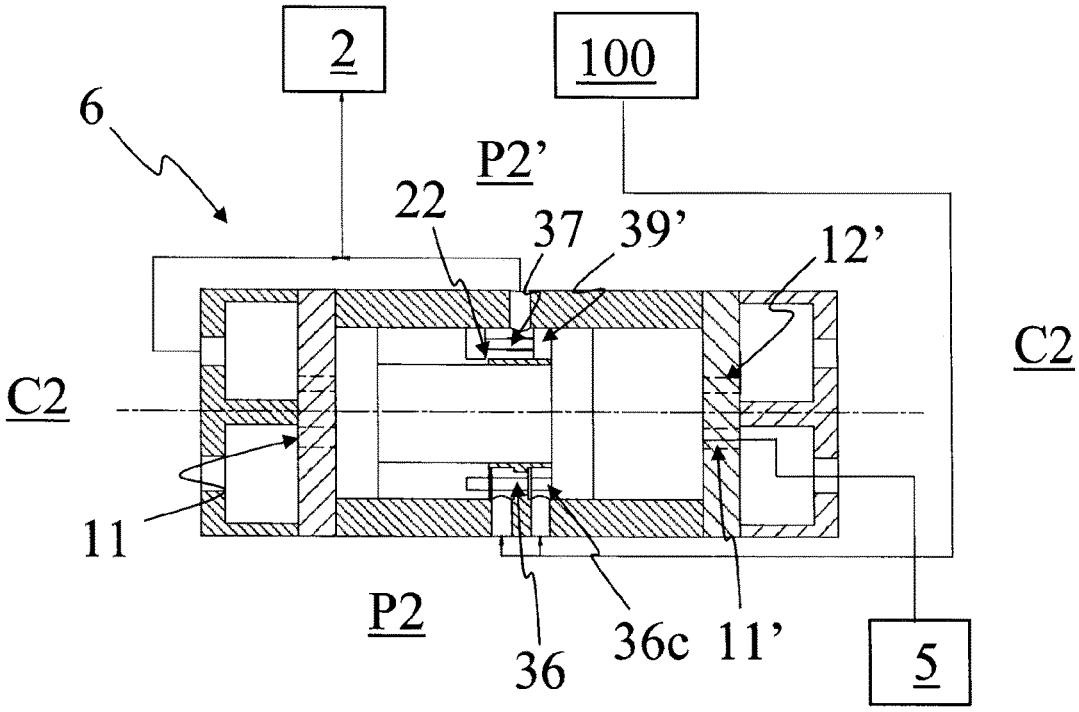
Figure 6D:
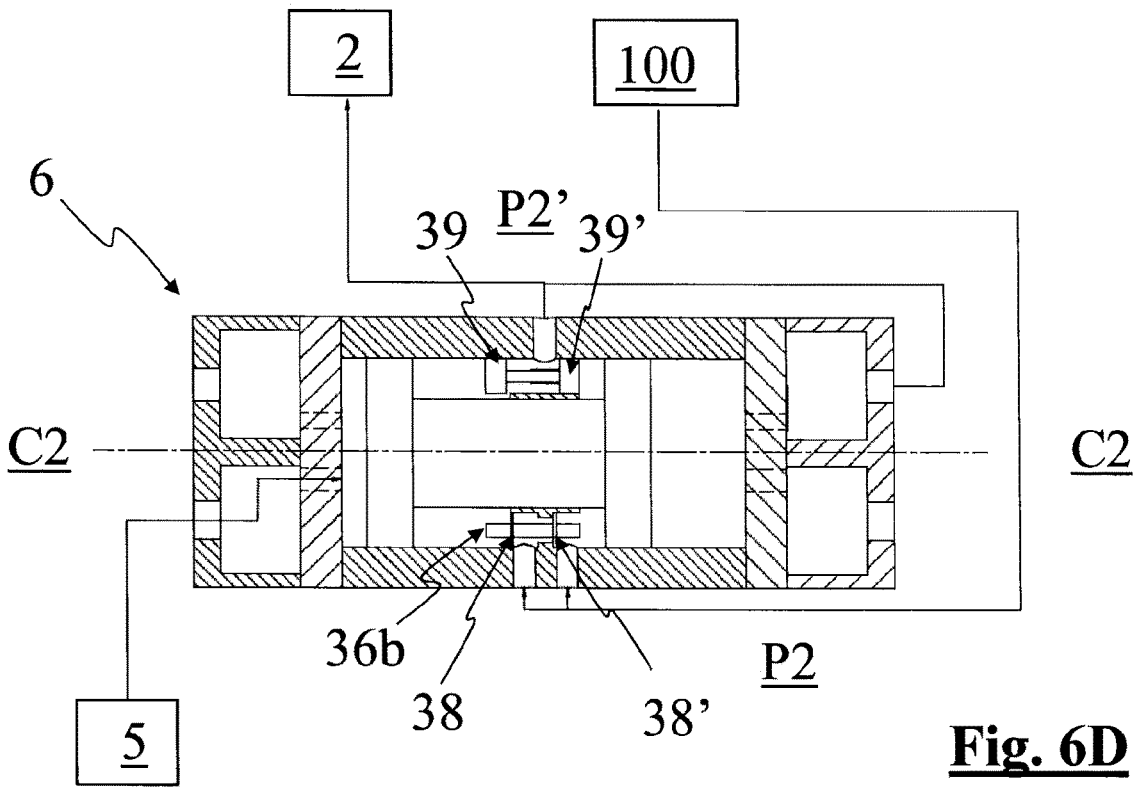

The control device 50 for controlling the actuation of the rod 8 comprises an inflow section 51 fluidically connected with the secondary economizer branch 100, on the side of the inlet section 100*a*, and an outflow section 52 fluidically connected with the outlet section 100*b* of the secondary economizer branch 100. However, in this embodiment, the inflow section 51 and the outflow section 52 of the reciprocating compressor 6 are obtained in the cylinder 7 of the reciprocating compressor 6 itself, such that the third port 21 and the fourth port 22 are arranged within the second chamber 20 of the cylinder 7 of the reciprocating compressor 6, as is anyhow clear in the description below. The cut-off means 30 comprise a first small piston 36 and a second small piston 37 which are arranged in the cylinder 7 within appropriate and respective cylindrical housings 36*a*, 37*a* within which they slide and can be translated from a respective first position P1 and P1' to take the first configuration C1 (FIGS. 6A and 6B), and a respective second position P2, P2' to take the second configuration C2 (FIGS. 6C and 6D). In particular, the first small piston 36 is provided with a first cut-off 38 and the second small piston 37 is provided with a second cut-off 39. The first cut-off 38 is adapted to uncover the third port 21, when the first small piston 36 is in the first position P1, for the inflow of the portion X2 of the fraction X1 of coolant into the second chamber 20, and to uncover the third port 21 when the first small piston 36 is in the second position P2. The second cut-off 39 is adapted to cover the fourth port 22, when the second small piston 37 is in its first position P1', and to uncover the fourth port 22 when the second small piston 37 is in its second position P2'. Thus, when the first small piston 36 is in its first position P1, the fluidic connection between the inflow section 51 and the third port 21 (configuration C1) is allowed, and the outflow of the portion X2 of the fraction of coolant from the fourth port 22 is not allowed, since the second small piston 37 is in its first position P1'. When the first small piston 36 is in its second position P2, the fluidic connection between the inflow section 51 and the third port 21 (configuration C2) is not allowed, and the outflow of the portion X2 of the fraction of coolant from the second chamber 20 through the fourth port 22 is simultaneously allowed, since the second small piston 37 is in its second position P2'.

The reciprocating compressor 6 further comprises an additional piston 9' integrally constrained to the rod 8 and translatable within the cylinder 7. The cylinder 7 is provided with an additional first chamber 10' comprising an additional first port 11' for the inflow of the coolant coming from the evaporator 5 and an additional second port 12' for the outflow of the compressed coolant contained in the additional first chamber 10' to reach the main compressor 1. The cylinder 7 further comprises an additional second chamber 20' fluidically separated from the additional first chamber 10' by the additional piston 9' and provided with an additional third port 21' for the inflow of an additional portion X2' of the fraction X1 of coolant, to displace the additional piston 9' and compress the coolant contained in the additional first chamber 10' and allow the simultaneous suction of the coolant from the evaporator 5 inside the first chamber 10. Moreover, the cylinder 7 is provided with an additional fourth port 22' for the outflow of the additional portion X2' of the fraction of coolant X1 at the end of the compression of the coolant contained in the additional first chamber 10' and the simultaneous compression of the portion X2 of the fraction X1 of coolant coming from the evaporator 5 and contained in the first chamber 10 by means of the piston 9.

According to an embodiment described herein, the control device 50 for controlling the actuation of the rod 8 further comprises an additional inflow section 51' obtained in the cylinder 7 of the reciprocating compressor 6, besides the inflow section 51, fluidically connected with the side of the secondary economizer branch 100 comprising the inlet section 100*a*. The cut-off means 30, at least when in the first configuration C1, do not allow the fluidic connection between the additional inflow section 51' and the additional third port 21' and allow the fluidic connection between the outflow section 52 and the additional fourth port 22', for the outflow of the additional portion X2' of the fraction of coolant from the additional second chamber 20' (FIGS. 6A and 6B), and when in the second configuration C2, allow the fluidic connection between the additional inflow section 51' and the additional third port 21', for the inflow of the additional portion X2' of the fraction X1 of coolant into the additional second chamber 20', and do not allow the fluidic connection between the outflow section 52 and the additional fourth port 22' (FIGS. 6C and 6D).

Moreover, the first small piston 36 is provided with an additional first cut-off 38' and the second small piston 37 is equipped with an additional second cut-off 39'. The additional first cut-off 38' is adapted to cover the additional third port 21' when the first small piston 36 is in its first position P1 and to uncover the additional third port 21' when the first small piston 36 is in its second position P2. The additional second cut-off 39' is adapted to uncover the additional fourth port 22' when the second small piston 37 is in its first position P1' and to cover the additional fourth port 22' when the second small piston 37 is in its second position P2'. According to a particular aspect of the invention, the first small piston 36 is provided with a first protruding end 36*b* and a second protruding end 36*c* both dimensioned such that the first small piston 36 can be displaced from the first position P1 to the second position P2, and vice-versa, respectively under the action of the piston 9 and of the additional piston 9', at least at the end of the respective step of suctioning the coolant coming from the evaporator 5 in the first chamber 10 and in the additional first chamber 10'.

Moreover, the second cut-off 39 and the additional second cut-off 39' of the second small piston 37 are shaped such that the second small piston 37 can be displaced from the first position P1' to the second position P2', and vice-versa, under the action of the additional piston 9' and of the piston 9, at least at the end of the respective step of suctioning the coolant coming from the evaporator 5 in the additional first chamber 10' and in the first chamber 10.

The presence of the first protruding end 36*b*, the second protruding end 36*c* and the particular shape of the second cut-off 39 and of the additional second cut-off 39' allows to displace the first small piston 36 and the second small piston 37 from their first positions P1, P1' to their second positions P2, P2', and vice-versa, without the intervention of external mechanisms or consumption of electric power, but simply by exploiting the stroke of the piston 9 or of the additional piston 9'.

The embodiments described above all share the same operating method, which comprises the steps of:

a) circulating said coolant along said main branch of said closed circuit;

b) circulating said at least one fraction of flow rate of said coolant along said at least one secondary economizer branch of said closed circuit;

c) driving the operations of said reciprocating compressor;

wherein the step c) comprises the step c1) of diverting a portion X2 of the fraction X1 of coolant coming from the secondary economizer branch 100 to drive the displacement of the piston 9 of the reciprocating compressor 6 and thus compress the coolant coming from the evaporator 5 contained in the cylinder 7, and the step c2) of reintroducing the same portion X2 of fraction of coolant into the secondary economizer branch 100 during the displacement of the piston 9 in the step of suctioning the coolant coming from the evaporator 5, for the outflow of the portion X2 of fraction of coolant through the outlet section 100*b* of the secondary economizer branch 100. The outlet section of the secondary economizer branch 100 is arranged downstream of the reciprocating compressor 6 such that the aforesaid portion X2 of coolant coming out of the secondary economizer branch 100 is mixed with the coolant coming out of the reciprocating compressor 6 before entering the main compressor 2.

The invention claimed is:

1. A refrigeration apparatus having a closed circuit (C) in which a flow rate (P) of coolant circulates, said closed circuit comprising a main branch (M) provided with a main compressor, a cooling device to cool said coolant, expansion means to expand the coolant and an evaporator, said closed circuit further comprising a secondary economizer branch for a fraction of flow rate (X1) of said coolant, wherein an inlet section of said secondary economizer branch is arranged in a length of said closed circuit (C) between said cooling device and said expansion means and an outlet section of said secondary economizer branch is arranged in proximity of the suction of said main compressor, wherein said main branch (M) further comprises a reciprocating compressor arranged between said evaporator and said main compressor and provided with a cylinder, a rod and a piston, the piston being integrally constrained to said rod and translatable inside said cylinder, and wherein said secondary economizer branch comprises a control device for controlling actuation of said rod and adapted to divert at least one portion (X2) of said fraction (X1) of coolant coming from said secondary economizer branch to drive the displacement of said piston and compress the coolant coming from said evaporator and contained in said cylinder, and to reintroduce said portion (X2) of said fraction of coolant into said secondary economizer branch during the displacement of said piston in the step of suctioning the coolant coming from said evaporator, for the outflow of said portion (X2) of said fraction of coolant through said outlet section of said secondary economizer branch, wherein said outlet section of said secondary economizer branch is arranged downstream of said reciprocating compressor.

2. The refrigeration apparatus according to claim 1, wherein said cylinder is provided with a first chamber comprising a first port for an inflow of the coolant coming from said evaporator and a second port for an outflow of the compressed coolant contained in said first chamber in order to reach said main compressor, said cylinder further comprising a second chamber fluidically separated from said first chamber by said piston and provided with a third port for the inflow of said portion (X2) of said a fraction (X1) of coolant for displacing said piston and compressing said coolant contained in said first chamber.

3. The refrigeration apparatus according to claim 2, wherein said third port is further suitable for the outflow of said portion (X2) of said fraction of coolant, at the end of the compression of the coolant contained in said first chamber, in order to reach said outlet section of said secondary economizer branch.

4. The refrigeration apparatus according to claim 3, wherein said control device for controlling actuation of said rod comprises an inflow section fluidically connected with said secondary economizer branch, an outflow section fluidically connected with said outlet section of said secondary economizer branch, and cut-off means switching between a first configuration (C1), wherein the fluidic connection between said inflow section and said third port is allowed, for the inflow of said portion (X2) of said fraction (X1) of coolant into said second chamber, and a second configuration (C2), wherein the fluidic connection between said outflow section and said third port is allowed, for the outflow of said portion (X2) of said fraction (X1) of coolant from said second chamber and the fluidic connection between said inflow section and said third port is not allowed.

5. The refrigeration apparatus according to claim 4, wherein said control device for controlling actuation comprises a cylinder body, said cut-off means comprising translatable shaft that can translate within said cylinder between a first position (P1) in said first configuration (C1), and a second position (P2) in said second configuration (C2), said translatable shaft being provided with a first cut-off and a second cut-off, said first cut-off and said second cut-off being arranged spaced apart from one another along said translatable shaft such that, in said first position (P1), the fluidic connection between said inflow section and said third port is allowed, for the inflow of said portion (X2) of said fraction (X1) of coolant into said second chamber, and in said second position (P2) the fluidic connection between said outflow section and said third port is allowed, for the outflow of said portion (X2) of said fraction (X1) of coolant from said second chamber, and the fluidic connection between said inflow section and said a third port is not allowed.

6. The refrigeration apparatus according to claim 2, wherein said reciprocating compressor comprises an additional piston integrally constrained to said rod and translatable within said cylinder, wherein said cylinder is provided with an additional first chamber comprising an additional first port for the inflow of the coolant coming from said evaporator and an additional second port for the outflow of the compressed coolant contained in said additional first chamber to reach said main compressor, said cylinder further comprising an additional second chamber fluidically separated from said additional first chamber by said additional piston and being provided with an additional third port for the inflow of an additional portion (X2') of said fraction (X1) of coolant in order to displace said additional piston and compress said coolant contained in said additional first chamber and allow the simultaneous suction of coolant from said evaporator into said first chamber, and for the outflow of said additional portion (X2') of said fraction of coolant following the compression of the coolant contained in said additional first chamber and the simultaneous compression of coolant contained in said first chamber by said piston.

7. The refrigeration apparatus according to claim 6, wherein said control device for controlling actuation of said rod further comprises an additional outflow section fluidically connected with said outlet section of said secondary economizer branch, and in that said cut-off means, at least when in said first position (P1), allow the fluidic connection between said additional outflow section and said additional third port, for the outflow of said additional portion (X2') of the fraction of coolant (X1) from said additional second chamber, and at least when in said second position (P2), allow the fluidic connection between said inflow section and said additional third port, for the inflow of said additional portion (X2') of the fraction (X1) of the coolant to said additional second chamber.

8. The refrigeration apparatus according to claim 7, wherein said cut-off means comprise a third cut-off constrained to said shaft that can translate, said third cut-off being spaced apart from said first cut-off and said second cut-off along said shaft such that, at least when said translatable shaft is in said first position (P1), the fluidic connection between said additional outflow portion and said additional third port is allowed, for the outflow of said additional portion (X2') of the fraction of coolant (X1) from said additional second chamber, and at least when in said second position (P2), the fluidic connection between said inflow section and said additional third port is allowed, for the inflow of said additional portion (X2') of the fraction (X1) of the coolant into said additional second chamber.

9. The apparatus according to claim 2, wherein said control device for controlling actuation of said rod comprises drive means to drive the switching of said cut-off means between said first configuration (C1) and said second configuration (C2), and vice versa, depending on the position of said rod within said cylinder.

10. The apparatus according to claim 9, wherein said drive means comprise a switching button arranged within said first chamber and one second switching button arranged within said additional first chamber, said first switching button being activated by said piston, at the end of the compression step of said coolant contained in said first chamber, in order to drive the switching of said cut-off means from said first configuration (C1) to said second configuration (C2), said second switching button being activated by said additional piston, at the end of the compression step of said coolant contained in said additional first chamber, to drive the switching of said cut-off means from said second configuration (C2) to said first configuration (C1).

11. The apparatus according to claim 10, wherein said cylinder body of said control device for controlling actuation comprises a first terminal volume (V1) fluidically connected with said length of said main branch comprised between said main compressor and said reciprocating compressor, wherein said first volume (V1) comprises an elastic element to force said cut-off means to remain in said second configuration (C2), and a second terminal volume (V2) fluidically connected in a controlled and reciprocating way with said length of said main branch comprised between said main compressor and said reciprocating compressor, at least when said first switching button is activated by said piston, in order to drive the switching of said cut-off means from said first configuration (C1) to said second configuration (C2), and with said secondary economizer branch, at least when said second switching button is actuated by said additional piston, in order to drive the switching of said cut-off means from said second configuration (C2) to said first configuration (C1).

12. The refrigeration apparatus according to claim 2, wherein said second chamber is provided with a fourth port for the outflow of said portion (X2) of said fraction of coolant, at the end of the compression of the coolant contained in said first chamber, in order to reach said outlet section of said secondary economizer branch.

13. The refrigeration apparatus according to claim 12, wherein said control device for controlling the actuation of said rod comprises an inflow section fluidically connected with said secondary economizer branch, and an outflow section fluidically connected with said outlet section of said secondary economizer branch, and cut-off means switching from a first configuration (C1), wherein the fluidic connection between said inflow section and said at least one third port is allowed, for the inflow of said portion (X2) of said fraction (X1) of coolant into said second chamber, to a second configuration (C2), wherein the fluidic connection between said outflow section and said at least one fourth port is allowed, for the outflow of said portion of said fraction of coolant from said second chamber and the fluidic connection between said inflow section and said a third port is not allowed.

14. The refrigeration apparatus according to claim 13, wherein said inflow section and said outflow section are obtained in said cylinder of said reciprocating compressor, said cut-off means comprising a first small piston and a second small piston both arranged within said cylinder and translatable within a respective first cylinder cavity obtained in said cylinder, between a respective first position (P1, P1'), in order to take said first configuration (C1), and a respective second position (P2, P2'), in order to take said second configuration (C2), said first small piston being provided with a first cut-off and said second small piston being provided with a second cut-off, said first cut-off being adapted to uncover said third port at least when said first small piston is in said first position (P1) and to cover said third port at least when said first small piston is in said second position (P2), said second cut-off being adapted to cover said fourth port at least when said second small piston is in said first position (P1') and to uncover said fourth port at least when said second small piston is in said second position (P2').

15. The apparatus according to claim 14, wherein said first small piston is provided with an additional first cut-off and said second small piston is provided with an additional second cut-off, said additional first cut-off being adapted to cover said additional third port at least when said first small piston is in said first position (P1) and to uncover said additional third port at least when said first small piston is in said second position (P2), said additional second cut-off being adapted to uncover said additional fourth port at least when said second small piston is in said first position (P1') and to cover said additional fourth port at least when said second small piston is in said second position (P2').

16. The refrigeration apparatus according to claim 12, wherein said reciprocating compressor comprises an additional piston integrally constrained to said rod and translatable within said cylinder, wherein said cylinder is provided with an additional first chamber comprising an additional first port for the inflow of the coolant coming from said evaporator and an additional second port for the outflow of the compressed coolant contained in said additional first chamber to reach said main compressor, said cylinder further comprising an additional second chamber fluidically separated from said additional first chamber by said additional piston and being provided with an additional third port for the inflow of an additional portion (X2') of said fraction (X1) of coolant in order to displace said additional piston and compress said coolant contained in said additional first chamber and allow the simultaneous suction of coolant from said evaporator into said first chamber, and with an additional fourth port for the outflow of said additional portion (X2') of said fraction of coolant (X1) at the end of the compression of the coolant contained in said additional first chamber and the simultaneous compression of coolant contained in said first chamber by said piston.

17. The refrigeration apparatus according to claim 16, wherein said control device for controlling actuation of said rod further comprising additional inflow section obtained in said cylinder, fluidically connected with said secondary economizer branch, said cut-off means, at least when in said first configuration (C1), preventing the fluidic connection between said additional inflow section and said additional third port and allowing the fluidic connection between said outflow section and said additional fourth port, for the outflow of said additional portion (X2') of said fraction of coolant from said additional second chamber, and at least when in said second configuration (C2), allowing the fluidic connection between said additional inflow section and said additional third port, for the inflow of said additional portion (X2') of said fraction (X1) of coolant into said additional second chamber and wherein the fluidic connection between said outflow section and said additional fourth port is not allowed.

18. The apparatus according to claim 15, wherein said first small piston is provided with a first protruding end and a second protruding end both dimensioned such that said first small piston can be displaced from said first position (P1) to said second position (P2), and vice versa, respectively under the action of said piston and said additional piston, at least at the end of the respective step of suctioning said coolant coming from said evaporator in said first chamber and in said additional first chamber.

19. The apparatus according to claim 15, wherein said second cut-off and said additional second cut-off of said second small piston are shaped such that said second small piston can be displaced from said first position (P1') to said second position (P2'), and vice versa, under the action of said additional piston and said piston, at least at the end of the respective step of suctioning said coolant coming from said evaporator in said additional first chamber and in said first chamber.

20. The apparatus according to claim 1, wherein said coolant comprises carbon dioxide, or other gas or gas mixture having similar chemical and/or physical properties.

21. A method for operating a refrigeration apparatus according to claim 1, comprising:

a) circulating said coolant along said main branch (M) of said closed circuit (C);

b) circulating said fraction (X1) of flow rate of said coolant along said secondary economizer branch of said closed circuit; and c) driving the operations of said reciprocating compressor;

wherein said step c) comprises the step c1) of diverting a portion (X2) of said fraction (X1) of coolant coming from said secondary economizer branch in order to drive the displacement of said piston of said reciprocating compressor and compress the coolant coming from said evaporator contained in said cylinder, and the step c2) of reintroducing said portion (X2) of fraction of cooling liquid into said secondary economizer branch during the displacement of said piston in the step of suctioning the coolant coming from said evaporator, for the outflow of said portion (X2) of fraction of coolant through said outlet section of said secondary economizer branch, wherein said outlet section of said secondary economizer branch is arranged downstream of said reciprocating compressor.

* * * * *